United States Patent [19]

Nystrom et al.

[11] Patent Number: 5,076,296

[45] Date of Patent: Dec. 31, 1991

[54] CARBON HEAT SOURCE

[75] Inventors: William S. Nystrom; Leo C. Lanzel, both of St. Marys, Pa.; Harry V. Lanzillotti; Charles R. Hayward, both of Midlothian, Va.; A. C. Lilly, Jr., Chesterfield; John R. Hearn, Midlothian, both of Va.

[73] Assignee: Philip Morris Incorporated, New York, N.Y.

[21] Appl. No.: 223,232

[22] Filed: Jul. 22, 1988

[51] Int. Cl.[5] ..... A24B 15/16; A24D 1/18; A24D 1/00

[52] U.S. Cl. ..... 131/359; 131/369; 131/194; 44/520; 44/522

[58] Field of Search ..... 131/359, 369, 194; 44/520, 522

[56] References Cited

U.S. PATENT DOCUMENTS

| | | | |
|---|---|---|---|
| 2,907,686 | 10/1959 | Siegel | 131/359 |
| 3,258,015 | 6/1966 | Ellis et al. . | |
| 3,356,094 | 12/1967 | Ellis et al. . | |
| 3,943,941 | 3/1976 | Boyd et al. . | |
| 4,079,742 | 3/1978 | Rainer et al. . | |
| 4,133,317 | 1/1979 | Briskin . | |
| 4,219,031 | 8/1980 | Rainer et al . | |
| 4,256,123 | 3/1981 | Lendvay et al. . | |
| 4,256,126 | 3/1981 | Seligman et al. . | |
| 4,286,604 | 9/1981 | Ehretsmann et al. . | |
| 4,326,566 | 4/1982 | Hardwick et al. . | |
| 4,340,072 | 7/1982 | Bolt et al. . | |
| 4,481,958 | 11/1984 | Rainer et al. . | |
| 4,708,151 | 11/1987 | Shelar . | |
| 4,714,082 | 12/1987 | Banerjee et al. . | |
| 4,732,168 | 3/1988 | Resce et al. . | |
| 4,756,318 | 7/1988 | Clearman et al. . | |
| 4,793,365 | 12/1988 | Sensabaugh, Jr. et al. . | |
| 4,858,630 | 8/1989 | Banerjee et al. . | |

FOREIGN PATENT DOCUMENTS

| | | |
|---|---|---|
| 0117355 | 9/1984 | European Pat. Off. . |
| 0174645 | 3/1986 | European Pat. Off. . |
| 0236992 | 9/1987 | European Pat. Off. . |
| 0245732 | 11/1987 | European Pat. Off. . |
| 0254848 | 2/1988 | European Pat. Off. . |
| 0271036 | 6/1988 | European Pat. Off. . |
| 2416876 | 10/1974 | Fed. Rep. of Germany . |
| 54-24000 | 7/1988 | Japan . |
| 1431045 | 4/1976 | United Kingdom . |
| 2027580 | 1/1980 | United Kingdom . |
| 80/01132 | 1/1980 | World Int. Prop. O. . |

*Primary Examiner*—V. Millin

*Attorney, Agent, or Firm*—Jeffrey H. Ingerman

[57] ABSTRACT

A carbonaceous heat source for a smoking article is provided. The heat source is designed to maximize heat transfer to a flavor bed in the smoking article. The heat source undergoes substantially complete combustion leaving minimal residual ash, has a relatively low degree of thermal conductivity and ignites under normal lighting conditions for a conventional cigarette.

68 Claims, 2 Drawing Sheets

CARBON HEAT SOURCE

BACKGROUND OF THE INVENTION

This invention relates to a heat source used in smoking articles which produce substantially no visible sidestream smoke. More particularly, this invention relates to a carbon containing heat source for a smoking article which provides sufficient heat to release a flavored aerosol from a flavor bed for inhalation by the smoker.

There have been previous attempts to provide a heat source for a smoking article. However, these attempts have not produced a heat source that is satisfactory for use in a smoking article such as described in copending U.S. patent application Ser. No. 07/223,153, filed concurrently herewith and now U.S. Pat. No. 4,991,606.

For example, Siegel U.S. Pat. No. 2,907,686 discloses a charcoal rod having an ash content of between 10% and 20% and a porosity on the order of 50% to 60%. The charcoal rod is coated with a concentrated sugar solution so as to form an impervious layer during burning. It was thought that this layer would contain gases formed during smoking and concentrate the heat thus formed. The charcoal may or may not be activated.

Boyd et al. U.S. Pat. No. 3,943,941 discloses a tobacco substitute which consists of a fuel and at least one volatile substance impregnating the fuel. The fuel consists essentially of combustible, flexible and self-coherent fibers made of a carbonaceous material containing at least 80 percent carbon by weight. The carbon is the product of the controlled pyrolysis of a cellulose based fiber containing only carbon, hydrogen and oxygen, and which has suffered a weight loss of at least 60 percent during the pyrolysis.

Bolt et al. U.S. Pat. No. 4,340,072 discloses an annular fuel rod extruded or molded from tobacco, a tobacco substitute, a mixture of tobacco substitute and carbon, other combustible materials such as wood pulp, straw and heat-treated cellulose or an SCMC and carbon mixture. The wall of the fuel rod is substantially impervious to air.

Banerjee et al. U.S. Pat. No. 4,714,082 discloses a short combustible fuel element having a density greater than 0.5 g/cc. The fuel element disclosed in Banerjee has a plurality of longitudinal passageways in an attempt to maximize the heat transfer to the aerosol generator.

Published European patent application 0 117 355 by Hearn et al. discloses a carbon heat source and a process for making a carbon heat source for a smoking article. The carbon heat source is formed from pyrolized tobacco or other carbonaceous material and is in the shape of a tube. The process for making the carbon heat source comprises three steps: a pyrolysis step, a controlled cooling step and either an oxygen absorption step, a water desorption step or a salt impregnation and subsequent heat treatment step.

Published European patent application 0 236 992 by Farrier et al. discloses a carbon fuel element and process for producing the carbon fuel element. The carbon fuel element disclosed contains carbon powder, a binder and other additional ingredients as desired and is formed with one or more longitudinally extending passageways. The carbon fuel element is produced by pyrolizing a carbon containing starting material in a non-oxidizing atmosphere, cooling the pyrolized material in a non-oxidizing atmosphere, grinding the pyrolized material, adding binder to the ground material to form the fuel element and pyrolizing the formed fuel element in a nonoxidizing atmosphere. A heating step may be performed on the ground material after grinding.

Published European patent application 0 245 732 by White et al. discloses a dual burn rate fuel element which utilizes a fast burning segment and a slow burning segment.

All of these heat sources are deficient because they provide unsatisfactory heat transfer to the flavor bed resulting in an unsatisfactory smoking article, i.e., one which fails to simulate the flavor, feel and number of puffs of a conventional cigarette.

It would be desirable to provide a carbonaceous heat source that will maximize heat transfer to the flavor bed.

It also would be desirable to provide a heat source that undergoes substantially complete combustion leaving minimal residual ash.

It still further would be desirable to provide a heat source that will ignite under normal lighting conditions for a conventional cigarette.

SUMMARY OF THE INVENTION

It is an object of this invention to provide a carbonaceous heat source that will maximize heat transfer to the flavor bed.

It also is an object of this invention to provide a heat source that undergoes substantially complete combustion leaving minimal residual ash.

It is a still further object of this invention to provide a heat source that will ignite under normal lighting conditions for a conventional cigarette.

In accordance with this invention, there is provided a carbonaceous heat source for a smoking article. The heat source is formed from charcoal and has one or more longitudinal air flow passageways therethrough. Each longitudinal air flow passageway is in the shape of a multi-pointed star. When the heat source is ignited and air is drawn through the smoking article, air is heated as it passes through the longitudinal air flow passageways. The heated air flows through a flavor bed, releasing a flavored aerosol for inhalation by the smoker.

The heat source has a void volume greater than about 50% with a mean pore size of about one to about 2 microns, as measured on a mercury porosimeter. The heat source has a density of between about 0.2 g/cc and about 1.5 g/cc. The BET surface area of the charcoal particles used in the heat source is in the range of about 50 $m^2/g$ to about 2000 $m^2/g$. In addition, catalysts and oxidizers may be added to the charcoal to promote complete combustion and to provide other desired burn characteristics.

There is also provided a process for manufacturing the heat source of this invention. The process involves three basic steps: mixing charcoal of a desired size with appropriate additives, molding or extruding the mixture into the desired shape and baking the extruded or molded material. After baking, the extruded or molded material may be further machined to final tolerances.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
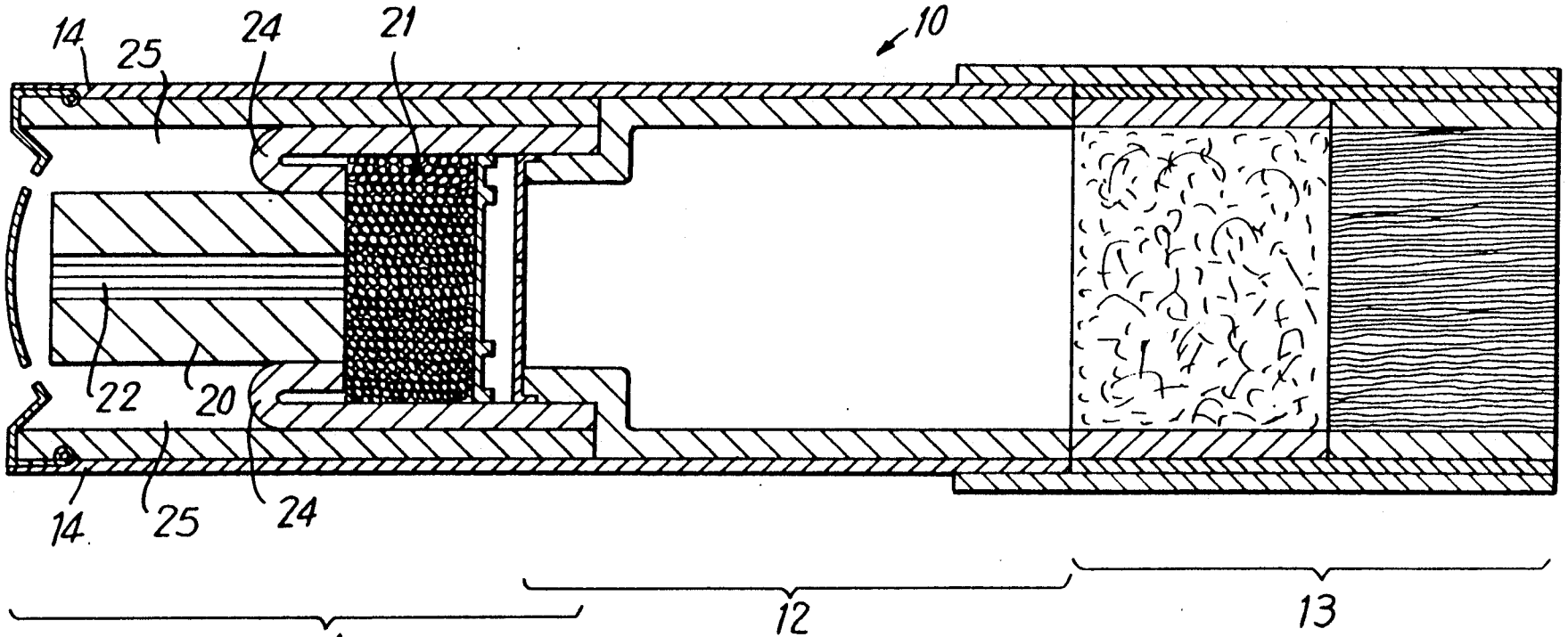
FIG. 1 is a longitudinal cross-sectional view of a smoking article in which the heat source of this invention may be employed.

Smoking article 10 consists of an active element 11, an expansion chamber tube 12, and a mouthpiece element 13, overwrapped by cigarette wrapping paper 14. Active element 11 includes a carbon heat source 20 and a flavor bed 21 which releases flavored vapors when contacted by hot gases flowing through heat source 20. The vapors pass into expansion chamber tube 12 forming an aerosol that passes to mouthpiece element 13, and thence into the mouth of a smoker.

Heat source 20 should meet a number of requirements in order for smoking article 10 to perform satisfactorily. It should be small enough to fit inside smoking article 10 and still burn hot enough to ensure that the gases flowing therethrough are heated sufficiently to release enough tobacco flavor from flavor bed 21 to provide conventional cigarette flavor to the smoker. Heat source 20 should also be capable of burning with a limited amount of air until the carbon in heat source 20 is expended. Ideally, heat source 20 leaves minimal ash after combustion. It also should produce significantly more carbon dioxide than carbon monoxide upon combustion. Heat source 20 should have a low degree of thermal conductivity. If too much heat is conducted away from the burning zone to other parts of heat source 20, combustion at that point will cease when the temperature drops below the extinguishment temperature of heat source 20. Finally, heat source 20 should ignite under normal lighting conditions for a conventional cigarette.

As discussed above, heat source 20 should leave minimal residual ash after combustion. Residual ash tends to form a barrier to the movement of oxygen into the unburned carbon of heat source 20. This residual ash may also be pulled into flavor bed 21 or fall out of smoking article 10. Thus, minimizing the amount of ash left after combustion is desirable.

It is possible to wash out ash-forming inorganic substances from charcoal with acid. However, this procedure would significantly increase the cost of heat source 20.

Heat source 20 may be formed from hardwood charcoal or softwood charcoal. Typically a softwood charcoal or a hardwood charcoal yields a heat source that is comprised of about 89% carbon, about 1% hydrogen, about 3% oxygen and about 7% ash-forming inorganic substances by weight. It is desirable to maximize the amount of pure carbon per gram of heat source 20 to provide sufficient fuel.

The charcoal may be derived from various carbon-yielding precursors such as wood, wood bark, peanut shells, coconut shells, tobacco, rice hulls, or any cellulose or cellulose-derived material that has a high carbon yield. These carbon-yielding precursors are carbonized using a semi-oxidizing process similar to that used to make wood charcoal or the bark fly ash process as described in U.S. Pat. No. 3,152,985.

Preferably, a softwood charcoal is used to produce heat source 20. Softwood charcoal is not as dense as hardwood charcoal making softwood charcoal easier to burn.

The charcoal may be activated or unactivated. Generally, activating the charcoal increases the charcoal's effective surface area. Increased effective surface area is important because this allows more oxygen to be present at the point of combustion, thus increasing ease of ignition and burning and providing minimal residue.

As discussed previously, it is desirable to prevent too much heat from being lost from heat source 20 to avoid extinguishing combustion of heat source 20. In addition, minimizing heat loss helps maintain heat source 20 near its combustion temperature between puffs by the smoker on smoking article 10. This minimizes the time necessary to raise the temperature of heat source 20 to its combustion temperature during a puff. This in turn ensures that sufficiently hot gases pass through flavor bed 21 throughout the puff by the smoker on smoking article 10 and thus maximizes the tobacco flavor released from flavor bed 21.

The external geometric surface area of heat source 20 should be minimized to minimize radiative heat loss. Preferably, minimization of the external geometric surface area of heat source 20 is accomplished by forming heat source 20 in the shape of a cylinder. Conductive heat loss to the surrounding wrapper of smoking article 10 may be minimized by ensuring that an annular air space is provided around heat source 20. Preferably heat source 20 has a diameter of about 4.6 mm and a length of about 10 mm. The 4.6 mm diameter allows an annular air space around heat source 20 without causing the diameter of smoking article 10 to be larger than the diameter of a conventional cigarette.

Figure 2:
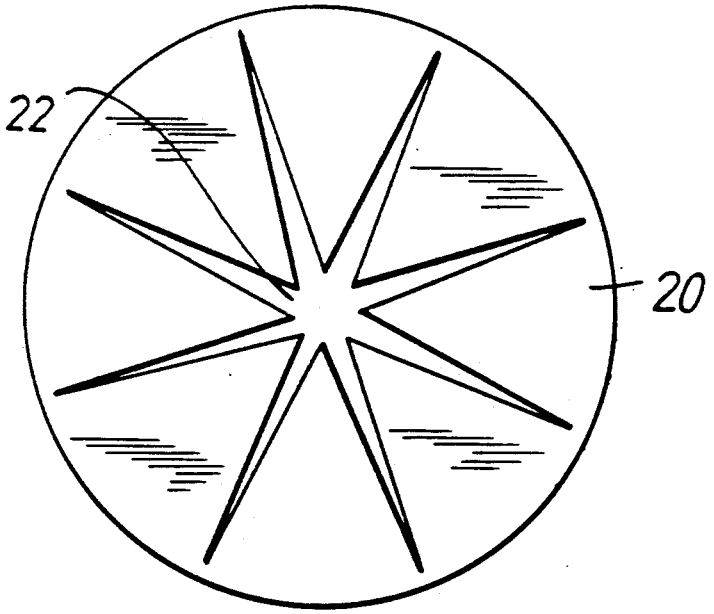
FIG. 2 is an end view of one embodiment of the heat source.

Heat source 20 should, however, transfer as much heat as possible to flavor bed 21. One means of accomplishing this heat transfer is to have one or more longitudinal air flow passageways 22 through heat source 20. Longitudinal air flow passageways 22 should have a large geometric surface area to improve the heat transfer to the air flowing through heat source 20. By maximizing the geometric surface area of longitudinal air flow passageways 22, heat transfer to flavor bed 21 is maximized. The shape and number of longitudinal air flow passageways 22 should be chosen such that the internal geometric surface area of heat source 20 is equal to or greater than the external geometric surface area of heat source 20. Preferably, maximization of heat transfer to flavor bed 21 is accomplished by forming each longitudinal air flow passageway 22 in the shape of a multi-pointed star. Even more preferably, each multi-pointed star should have long narrow points and a small inside circumference defined by the innermost edges of the star. (See FIG. 2.) In addition, maximizing the internal geometric surface area of heat source 20 by the use of one or more multi-pointed, star-shaped, longitudinal air flow passageways 22, results in a larger area of heat source 20 available for combustion. This larger combustion area results in a greater volume of carbon involved in combustion and therefore a hotter burning heat source.

As discussed previously, heat source 20 should also possess low thermal conductivity. Low thermal conductivity is desirable because heat source 20 should burn and transfer heat to the air flowing therethrough but not conduct heat to flavor bed 21. If heat source 20 conducts heat, the time required to promote combustion will increase. This is undesirable because smoking article 10 will take longer to light. Also, as discussed previously, heat must be maintained at the burning zone of heat source 20. Preferably a charcoal with a relatively low thermal conductivity is used to prevent the mounting structure 24 used to position heat source 20 in smoking article 10 from absorbing the high heat generated during combustion of heat source 20. Mounting structure 24 should retard oxygen from reaching the rear portion of the heat source 20 thereby helping to extinguish heat source 20 after flavor bed 21 has been consumed. This also prevents heat source fall-out.

The size of the raw charcoal particles is another important consideration for heat source 20. The charcoal should be in the form of small particles. These small particles provide more carbon surface area in heat source 20 available for combustion and results in a heat source that is more reactive. The size of these particles can be up to about 700 microns. Preferably these charcoal particles have an average particle size of about 5 microns up to about 30 microns. Various types of mills or other grinders may be used to grind the charcoal down to the desired size. Preferably a jet mill is used.

The BET surface area of the charcoal particles should be in the range of about 50 $m^2/g$ to about 2000 $m^2/g$. Preferably, the BET surface area of the charcoal particles should be in the range of about 200 $m^2/g$ to about 600 $m^2/g$. The higher the surface area the more reactive the charcoal becomes because of the greater availability of carbon surface to react with oxygen for combustion. This is desirable because it yields a hotter burning heat source and less residue.

Concomitant with the need for small charcoal particles is the need for enough oxygen, i.e., air, to promote combustion of the fuel. Sufficient oxygen is provided by ensuring that heat source 20 has a large void volume. Preferably the void volume of heat source 20 is about 50% to about 60%. Also, the pore size i.e., the space between the charcoal particles, preferably is about one to about two microns as measured on a mercury porosimeter.

A certain minimum amount of carbon is needed in order for smoking article 10 to provide a similar amount of static burn time and number of puffs to the smoker as would a conventional cigarette. Typically, the amount of heat source 20 that is combusted is about 65 mg of a carbon cylinder which is 10 mm long by 4.65 mm in diameter. A greater amount may be needed taking into account the volume of heat source 20 surrounded by and in front of mounting structure 24 which is not combusted. As discussed above, that portion of the heat source 20 surrounded by and in front of mounting structure 24 will not burn because of the lack of oxygen.

In addition to the amount of carbon, the rate of heat transfer, i.e., the amount of heat per weight of carbon transferred to the air passing through heat source 20, affects the amount of heat available to flavor bed 21. The rate of heat transfer depends on the design of heat source 20. As discussed previously, optimum heat transfer characteristics are achieved when the geometric surface area of longitudinal air flow passageways 22 is at least equal to and preferably greater than the outside geometric surface area of heat source 20. This may be achieved by the use of one or more longitudinal air flow passageways 22 each being in the shape of a multipointed star having long, narrow points and a small inside circumference defined by the innermost edges of the star.

Heat source 20 should have a density of from about 0.2 g/cc to about 1.5 g/cc. Preferably, the density should be between about 0.5 g/cc and 0.8 g/cc. The optimum density maximizes both the amount of carbon and the availability of oxygen at the point of combustion. Theoretically the density can be as high as 2.25 g/cc, which is the density of pure carbon in its graphitic crystalline form. However, if the density becomes too high the void volume of heat source 20 will be low. Lower void volume means that there is less oxygen available at the point of combustion. This results in a heat source that is harder to burn. However, if a catalyst is added to heat source 20, it is possible to use a dense heat source, i.e., a heat source with a small void volume having a density approaching 2.25 g/cc.

Certain additives may be used in heat source 20 to either lower the ignition temperature of heat source 20 or to otherwise aid in the combustion of heat source 20. This aid may take the form of promoting combustion of heat source 20 at a lower temperature or with lower concentrations of oxygen or both.

Sources of metal ions, such as potassium ions or iron ions may be used as catalysts. These potassium ions or iron ions promote combustion of heat source 20 at a lower temperature or with lower concentrations of oxygen available to the heat source than would occur in heat source 20 without the catalyst. Potassium carbonate, potassium citrate, iron oxide, iron oxalate, calcium oxalate, ferric citrate or ferrous acetate may be used. Other potential catalysts include compounds of molybdenum, aluminum, sodium, calcium and magnesium. To ensure uniform distribution of these additives throughout heat source 20, these additives preferably are water soluble.

Iron oxide, iron oxalate or calcium oxalate may provide the added benefit of supplying more oxygen to heat source 20. This added oxygen may aid in the combustion of heat source 20. Other known oxidizers may also be added to heat source 20 to promote more complete combustion of heat source 20.

As discussed previously, heat source 20 should have a minimal amount of ash-forming inorganic substances. However, charcoal has an ash-forming inorganic substance content of about 5% and the addition of metal catalysts increases the ash-forming inorganic substance content to about 6% to about 8%. An ash-forming inorganic substance content of up to about 18% is acceptable but an ash-forming inorganic substance content of up to about 8% is preferred.

Heat source 20 can be manufactured according to the following process. First, charcoal should be ground to the desired size. As discussed previously, the particle size can be up to about 700 microns. Preferably the particles are ground to an average particle size of about 5 microns up to about 30 microns.

The binder used to bind the charcoal particles together is preferably a two-part binder system using relatively pure raw materials. The first binder is a flour such as the flour of wheat, barley, corn, oat, rye, rice, sorghum, mayo or soybean. The highprotein (12–16%) or high-gluten (12–16%) flours of those listed above are preferred. Even more desirable is a high-protein wheat flour. The higher protein level flours are desirable because they increase the binding properties of the flour, thus increasing the strength of the finished carbon heat source. The second binder is a monosaccharide or disaccharide, preferably sucrose (table sugar). The use of sucrose reduces the amount of flour needed. It also aids in the extrusion of the mixture. Both of these binders form a relatively reactive carbon material upon carbonization. It is also possible to produce a carbon heat source with a one-binder system of flour or other known binders.

As discussed below, varying concentrations of binders can be used, but it is desirable to minimize the binder concentration to reduce the thermal conductivity and improve the burn characteristic of heat source 20. The binders used are carbonized and leave behind a carbon skeleton sufficient to bind the carbon particles together. The carbonizing process minimizes the likelihood that complex products will be formed from the uncarbonized binders during combustion of heat source 20.

After the charcoal is ground to the desired size, it is mixed with the flour, sugar, one or more burn additives, and water and mixed for a set period of time. In the preferred embodiment, about 4 weight percent to about 45 weight percent, more preferably about 7 weight percent to about 30 weight percent, of a high protein wheat flour is used. In the preferred embodiment, about 1 weight percent to about 25 weight percent, more preferably about 5 weight percent to about 14 weight percent, of sugar is used. In the preferred embodiment, about 20 weight percent to about 95 weight percent, more preferably about 50 weight percent to about 85 weight percent, of charcoal is used. In the preferred embodiment, up to about 8 weight percent, more preferably about 2.7 weight percent to about 5 weight percent, of potassium citrate is used. Preferably iron oxide is also added to the mixture. In the preferred embodiment, up to about 2 weight percent, more preferably about 0.3 weight percent to about 1 weight percent, of iron oxide is used. Water is added in an amount sufficient to form an extrudable paste from the mixture.

The period of time for mixing can be determined by simple routine experimentation. The mixing should ensure thorough distribution of the various substances. Preferably, if a large volume is to be mixed in a batch mode, mixing should be for about 15 minutes to about one hour. If a small volume is to be mixed in a continuous mode, for example, in a continuous mixing-extruder, mixing need only be performed for a few seconds.

The mixture is then molded or extruded into the desired shape. Extrusion is preferable because this method is less expensive than molding. If heat source 20 is to be extruded, an extrusion aid, such as any vegetable oil like corn oil, may be added to the mixture about five minutes before the set period of time expires. The oil lubricates the mixture facilitating its extrusion. Various types of extruders manufactured by various companies can be used. A mud chamber or a continuous mixing extruder such as a Baker-Perkins twin-screw extruder is preferred. The extruded density of the mixture should be between about 0.75 g/cc and about 1.75 g/cc.

After the mixture has been molded or extruded, it may be dried to a moisture content of between about 2 percent to about 11 percent, preferably between about 4 percent and about 6 percent. The dried, extruded or molded material is then baked in an inert atmosphere at a temperature sufficient to carbonize the binders and drive off volatiles from heat source 20. The charcoal may also be baked before it is mixed with the binder and catalyst to drive off residual organics. Typically, the extruded or molded material should be baked at a temperature of from about 500° F. to about 3000° F. Preferably the extruded or molded material is baked at a temperature of about 1400° F. to about 1800° F. The baking temperature must be high enough to drive off the volatiles from the extruded or molded material. However as the baking temperature increases, the thermal conductivity increases. As discussed previously, increased thermal conductivity of heat source 20 is an undesirable characteristic. Therefore, a compromise temperature must be chosen.

The inert atmosphere in which heat source 20 is baked is preferably helium or argon. By using either a helium or argon atmosphere naturally occurring nitrogen is removed. If a nitrogen atmosphere is used, the carbon will react with some of the nitrogen in the atmosphere. This will result in the formation of nitrogen oxides when heat source 20 is burned. As discussed previously, preferably the predominant combustion gas transmitted to the smoker is carbon dioxide.

During baking, the extruded or molded material will shrink in the range of about 4% to about 10%. Therefore the extruded or molded material should be molded or extruded to a size slightly larger than required for use as a heat source in order to take into account this shrinkage.

After the extruded or molded material is baked, it may be cooled in an inert atmosphere to below about 200° F. The extruded or molded material may also be cooled in an atmosphere comprised of a mixture of inert gases and oxygen or oxygen containing compounds. At this point, the extruded or molded material can then be cut to the desired length and ground to the final desired size for use as a heat source in a smoking article. The extruded or molded material can be first ground to the desired size and then cut to the desired length. Preferably, centerless grinding is used to grind the extruded or molded material to the final desired size.

EXAMPLE 1

The following mixture is blended in a Sigma Blade Mixer for approximately 30 minutes to make an extrudable mix:

65 g hardwood charcoal milled to an average particle size of 30 microns;

70 g unbleached wheat flour (Pillsbury's unbleached enriched wheat flour);

40 g sugar (Domino's pure cane sugar);

50 g water.

After blending, the mixture was extruded using a mud chamber type extruder to a size of 0.200 inches outside diameter by 24 inches long with a star-shaped inside passageway. The rod was then dried to a moisture level of about 5%. The rods were then cut or broken into 12-inch lengths, then packed into a stainless steel container which was flushed continuously with nitrogen. The container was then placed in an oven and baked to 1000° F. according to the following oven cycle:

Room Temperature to 425° F. in 3.5 hours;

425° F. to 525° F. for 1.5 hours;

525° F. to 1000° F. for 2 hours;

Hold at 1000° F. for 2 hours;

1000° F. to room temperature as fast as oven could cool.

Once cooled, the rods were removed from the stainless steel box, cut to 10 mm lengths, and used as a carbon heat source.

EXAMPLE 2

The following mixture is blended in a Sigma Blade Mixer for approximately 20 minutes:

119 grams of a softwood bark charcoal fly ash (also known as Bar Char or Bark Char) made by a process similar to U.S. Pat. No. 3,152,985. Before being used, the bark fly ash is activated by processing the bark charcoal through a rotor calciner with steam being injected into the calciner. The carbon thus obtained is then milled to 90%-325 mesh (Acticarb Industries brand "Watercarb" powdered activated carbon). The obtained powder is then jet-milled to a final average particle size of aproximately 10 to 12 microns.

44 grams of high-protein or high-gluten wheat flour (Pillsbury's "balancer" high-gluten untreated wheat flour).

1 gram of iron oxide, less than 44 microns in particle size.

Once blended, a solution of the following ingredients is added to the dry ingredients and mixed for 30 minutes:

120 grams water;

22 grams sugar (Domino's pure cane sugar);

9 grams potassium citrate.

Once mixed, 3 grams of corn oil (Mazola corn oil) were added to the mixture and mixed for an additional five minutes. The corn oil was used as an extrusion aid.

After blending, the mixture was extruded using a mud chamber type extruder to a size of 0.200 inches outside diameter by 12 inches long with a star-shaped inside passageway. The rods were collected from the extruder head on V-notched grooved graphite plates for ease of processing. The V-notched grooved graphite plates and extruded rods were then placed in a stainless steel container and continuously flushed with helium. The container was then placed in an oven and baked to 1700° F. according to the following oven cycle:

Room Temperature to 425° F. in 3.5 hours;

425° F. to 525° F. for 1.5 hours;

525° F. to 1700° F. for 2 hours;

Hold at 1700° F. for 3 hours;

1700° F. to room temperature as fast as oven could cool.

Once cooled, the V-notched grooved graphite plates and extruded rods were removed from the stainless steel container. The rods were removed from the graphite plate, cut to 10 mm lengths, and ground to a 4.65 mm outside diameter.

EXAMPLE 3

The procedure for Example 2 was repeated, except that the softwood bark charcoal fly ash (also known as Bar Char or Bark Char) made by a process similar to U.S. Pat. No. 3,152,985, was not activated.

EXAMPLE 4

The procedure for Example 2 was repeated, except the rods produced were dried to a moisture level of 5% and placed on the conveyor belt of a continuous-belt baking oven, which was maintained at 1700° F. and continuously flushed with helium or argon.

EXAMPLE 5

A twin-screw extruder was used to mix and continuously extrude a mixture of three components: (A) blended dry ingredients (9.7 lbs. of high protein or high-gluten wheat flour (Pillsbury's "balancer" high-gluten untreated wheat flour); 35.0 lbs. of carbon like that used in Example 2; and 0.29 lbs. iron oxide, less than 44 microns in particle size); (B) a solution containing 17.65 lbs. of water, 4.85 lbs. of sugar (Domino's pure cane sugar), 2.35 lbs. of potassium citrate; and (C) 17.65 lbs. of water (nominal value) in a ratio of 2.55 to 1.41 to 1.0.

The above three components were mixed and blended in the twin-screw extruder and extruded (adjusting the amount of water as necessary to achieve the proper consistency of the extruded rod) to a size of 0.195 inches outside diameter and cut to a 12-inch length. The rod produced also had a star-shaped inside passageway. The rods were then dried to a moisture level of about 5%. The rods were then placed on V-notched grooved graphite plates and further processed as in Example 2.

Thus it is seen that a carbonaceous heat source that maximizes heat transfer to the flavor bed, undergoes nearly complete combustion leaving minimal residual ash, has a relatively low degree of thermal conductivity, and will ignite under normal conditions for a conventional cigarette is provided. One skilled in the art will appreciate that the present invention can be practiced by other than the described embodiments, which are presented for purposes of illustration and not of limitation and the present invention is limited only by the claims which follow.

What is claimed is:

1. A heat source for use in a smoking article having one or more longitudinal fluid passages therethrough wherein the geometric surface area of said fluid passages is at least about equal to the outside geometric surface area of said heat source.

2. The heat source of claim 1 wherein said one or more fluid passages through said heat source ar formed in the shape of multi-pointed stars.

3. The heat source of claim 1 wherein said heat source is comprised of charcoal particles.

4. The heat source of claim 3 having an ash-forming inorganic substances content of up to about 18%.

5. The heat source of claim 3 having an ash-forming inorganic substances content of up to about 8%.

6. The heat source of claim 3 wherein said charcoal particles are derived from softwood charcoal.

7. The heat source of claim 3 wherein said charcoal particles are derived from hardwood charcoal.

8. The heat source of claim 3 wherein said charcoal is activated.

9. The heat source of claim 8 wherein said activation is accomplished by steam oxidation.

10. The heat source of claim 3 wherein said heat source contains at least one burn additive.

11. The burn additive of claim 10 selected from the group consisting of potassium citrate, potassium carbonate, iron oxide, calcium oxalate, iron oxalate, potassium ions, iron ions, ferric citrate, ferrous acetate, a molybdenum compound, an aluminum compound, a calcium compound, a magnesium compound, a sodium compound, oxidizers and combinations thereof.

12. The heat source of claim 3 having a carbon content of about 89 weight percent.

13. The heat source of claim 12 wherein said charcoal particles are derived from softwood charcoal.

14. The heat source of claim 13 wherein said charcoal is activated.

15. The heat source of claim 14 wherein said activation is accomplished by steam oxidation.

16. The heat source of claim 12 wherein said charcoal particles are derived from hardwood charcoal.

17. The heat source of claim 12 wherein said charcoal particles are up to about 700 microns in size.

18. The heat source of claim 12 wherein said charcoal particles are in the range of about 5 microns to about 30 microns in size.

19. The heat source of claim 18 having a void volume of about 50% to about 60%.

20. The heat source of claim 19 having a pore size of about one micron to about two microns.

21. The heat source of claim 20 wherein said charcoal particles have a BET surface area in the range of about 50 $m^2/g$ to about 2000 $m^2/g$.

22. The heat source of claim 20 wherein said charcoal particles have a BET surface area in the range of about 200 $m^2/g$ to about 600 $m^2/g$.

23. The heat source of claim 22 having a density of about 0.2 g/cc to about 1.5 g/cc.

24. The heat source of claim 23 having an ash-forming inorganic substances content of up to about 18%.

25. The heat source of claim 24 wherein said hat source contains at least one burn additive.

26. The burn additive of claim 25 selected from the group consisting of potassium citrate, potassium carbonate, iron oxide, calcium oxalate, iron oxalate, potassium ions, iron ions, ferric citrate, ferrous acetate, a molybdenum compound, an aluminum compound, a calcium compound, a magnesium compound, a sodium compound, oxidizers and combinations thereof.

27. The heat source of claim 23 having an ash-forming inorganic substances content of up to about 8%.

28. The heat source of claim 22 having a density of about 0.5 g/cc to about 0.8 g/cc.

29. The heat source of claim 3 wherein said charcoal particles are up to about 700 microns in size.

30. The heat source of claim 3 wherein said charcoal particles are in the range of about 5 microns up to about 30 microns in size.

31. The heat source of claim 3 wherein said charcoal particles have a BET surface area in the range of about 50 $m^2/g$ to about 2000 $m^2/g$.

32. The heat source of claim 3 wherein said charcoal particles have a BET surface area in the range of about 200 $m^2/g$ to about 600 $m^2/g$.

33. The heat source of claim 3 having a void volume of about 50% to about 60%.

34. The heat source of claim 3 having a pore size of about one micron to about two microns.

35. The heat source of claim 1 having a density of about 0.2 g/cc to about 1.5 g/cc.

36. The heat source of claim 1 having a density of about 0.5 g/cc to about 0.8 g/cc.

37. The heat source of claim 1 wherein said heat source is substantially cylindrical.

38. A process for making a heat source for a smoking article comprising the steps of:

(a) mixing charcoal particles derived from carbon-yielding precursors that have been carbonized in an oxidizing atmosphere with one or more additives;

(b) extruding or molding said charcoal and additives into a desired shape; and (c) baking said extruded or molded charcoal and additives.

39. The process of claim 38 wherein one of said additives is a binder.

40. The process of claim 39 wherein said binder is a flour.

41. The process of claim 39 wherein said binder is a monosaccharide or a disaccharide.

42. The process of claim 39 wherein said binder is a two-part binder.

43. The process of claim 42 wherein one binder of said two-part binder is flour and the other binder is a monosaccharide or a disaccharide.

44. The process of claim 43 wherein said flour is selected from the group consisting of flour of wheat, flour of barley, flour of corn, flour of rye, flour of rice, flour of sorghum, flour of may, flour of soybean, flour of oat, and combinations of thereof.

45. The process of claim 43 wherein said monosaccharide or disaccharide is sucrose.

46. The process of claim 38 further comprising adding oil to said charcoal and additives during said mixing step.

47. The process of claim 46 wherein said oil is a vegetable oil.

48. The process of claim 47 wherein said vegetable oil is corn oil.

49. The process of claim 38 wherein said baking step is performed at a temperature of from about 500° F. to about 3000° F.

50. The process of claim 38 wherein said baking step is performed at a temperature of from about 1400° F. to about 1800° F.

51. The process of claim 38 wherein said baking step is performed in an inert atmosphere.

52. The process of claim 51 wherein said inert atmosphere is helium.

53. The process of claim 51 wherein said inert atmosphere is argon.

54. The process of claim 38 further comprising drying said extruded or molded charcoal and additives prior to said baking step.

55. The process of claim 54 further comprising cooling said extruded or molded charcoal and additives after said baking step.

56. The process of claim 54 wherein said extruded or molded charcoal and additives is dried to a moisture content of between about two percent and about eleven percent.

57. The process of claim 54 wherein said extruded or molded charcoal and additives is dried to a moisture content of between about four percent and about six percent.

58. The process of claim 38 further comprising cooling said extruded or molded charcoal and additives after said baking step.

59. The process of claim 58 wherein said extruded or molded charcoal and additives is cooled to below about 200° F.

60. The process of claim 59 wherein said extruded or molded charcoal and additives is cooled in an inert atmosphere.

61. The process of claim 59 wherein said extruded or molded charcoal and additives is cooled in an atmosphere of inert gases and oxygen or oxygen compounds.

62. The process of claim 58 wherein said extruded or molded charcoal and additives is cooled in an inert atmosphere.

63. The process of claim 58 wherein said extruded or molded charcoal and additives is cooled in an atmosphere of inert gases and oxygen or oxygen compounds.

64. A carbon-containing heat source for use in a smoking article comprised of charcoal particles derived from carbon-yielding precursors that have been carbonized in an oxidizing atmosphere.

65. The carbon-containing heat source of claim 64 having one or more longitudinal fluid passages therethrough wherein each of said fluid passages is formed in the shape of multi-pointed star.

66. The carbon-containing heat source of claim 65 wherein the geometric surface area of said one or more fluid passages is at least equal to the outside geometric surface area of said hat source.

67. The carbon-containing heat source of claim 64 having one or more longitudinal fluid passages therethrough wherein the geometric surface area of said one or more fluid passages is at least about equal to the outside geometric surface area of said heat source.

68. A carbon containing heat source for use in a smoking article having one or more longitudinal fluid passages therethrough formed in the shape of multi-pointed stars.

* * * * *